US005501446A

United States Patent [19]

Takemoto et al.

[11] Patent Number: 5,501,446

[45] Date of Patent: Mar. 26, 1996

[54] PAPER STRIP TRANSPORTING APPARATUS

[75] Inventors: Takatoshi Takemoto; Koichi Tsubota, both of Tokyo; Hideyuki Kadomatsu, Odawara; Etsuro Sasaki, Kawasaki, all of Japan

[73] Assignee: Kabushiki Kaisha Ace Denken, Tokyo, Japan

[21] Appl. No.: 240,709

[22] PCT Filed: Nov. 9, 1992

[86] PCT No.: PCT/JP92/01449

§ 371 Date: May 9, 1994

§ 102(e) Date: May 9, 1994

[87] PCT Pub. No.: WO93/09047

PCT Pub. Date: May 13, 1993

[30] Foreign Application Priority Data

Nov. 8, 1991 [JP] Japan ..... 3-293279
Nov. 8, 1991 [JP] Japan ..... 3-293280

[51] Int. Cl.[6] ..... B65H 29/70

[52] U.S. Cl. ..... 271/188; 271/198; 271/272; 271/275

[58] Field of Search ..... 271/188, 198, 271/272, 264, 275

[56] References Cited

U.S. PATENT DOCUMENTS 4,744,555 5/1988 Naramore et al. .

FOREIGN PATENT DOCUMENTS

| | | | |
|---|---|---|---|
| 038918 | 11/1981 | European Pat. Off. . | |
| 61-185749 | 11/1986 | Japan . | |
| 62-47551 | 3/1987 | Japan . | |
| 62-47550 | 3/1987 | Japan . | |
| 3-83747 | 4/1991 | Japan . | |
| 2235676 | 3/1991 | United Kingdom | 271/272 |

OTHER PUBLICATIONS

"Simplified O–Ring Document Transport", L. M. McDaniels, *IBM Disclosure Bulletin*, vol. 17 No. 12, May 1975, p. 3507.

*Primary Examiner*—David H. Bollinger
*Attorney, Agent, or Firm*—Lowe, Price, LeBlanc & Becker

[57] ABSTRACT

A paper strip transporting apparatus includes a drive pulley and a driven pulley (22, 23) which are separated from each other; a belt (25) which is disposed between and around the pulleys; a plurality of transporting rollers (27, 28) disposed along the belt (25) between the drive and driven pulleys (22, 23); and a drive unit (21) for driving drive pulley (22). Either one of the transporting rollers (27, 28) and the belt (25) has a convex portion and the other has a concave portion corresponding thereto at respective facing areas thereof. The transporting rollers (27, 28) are disposed with respect to the belt (25) so that the convex portion is positioned within the concave portion in a non-contacting relationship therebetween.

11 Claims, 8 Drawing Sheets

PAPER STRIP TRANSPORTING APPARATUS

TECHNICAL FIELD OF THE INVENTION

The present invention relates to a paper strip transporting apparatus and in particular to a paper strip transporting apparatus using a belt.

BACKGROUND OF THE RELATED TECHNOLOGY

In an apparatus or facility which processes paper strips, in particular an apparatus into which bills or bank notes are inserted as payment, such as automatic lending machines, it is necessary to collect bank notes. For example, a number of game media lending machines for lending game media used for playing games are installed in game parlors. Collecting of bank notes which have been inserted into the game media lending machines is carried out. There are problems in that collecting of bank notes from lending machines is troublesome and accidental loss and/or stealing of bank notes is liable to occur. Therefore, a transporting apparatus which accepts the inserted bank notes and transports them to a destination such as cash box is required for several game media lending machines.

For example, in game parlors, a plurality of game machines and a plurality of game media lending machines are arranged into one group. A plurality of the groups are arranged into an island. For each group, there is provided a transporting apparatus for collecting the bank notes inserted into a plurality of game media lending machines to one position.

Such type of paper strip transporting apparatus including drive and driven pulleys and a belt arranged between and around the pulleys have been heretofore used. A plurality of transporting rollers are disposed along the belt and between the drive and driven pulleys. This causes the bank notes to be sandwiched between the rollers and the belt and to be transported together with the belt by the frictional force thereof. The transporting rollers are disposed in pressure contact with the belt for bringing the paper strip into pressure contact with the belt.

The transporting rollers are constantly in pressure contact with the belt in the conventional transporting apparatus. Accordingly, the transporting rollers are constantly driven to rotate by the belt independently of presence or absence of the bank note. Therefore, there is a problem that the belt is liable to break due to wear of the portion which is in contact with the transporting rollers. In other words, there is a problem in that the durability of the belt is low. The transporting rollers have a similar problem of wear.

Noise which is generated due to continuous rotation of all transporting rollers is not negligible.

SUMMARY OF THE INVENTION

It is a principal object of the present invention to provide a paper strip transporting apparatus which is capable of transporting paper strips without bringing transporting rollers into contact with a belt and is capable of preventing wear of the belt and the transporting rollers due to mutual contact therebetween and in which their durability is enhanced.

It is a second object of the present invention to provide a paper strip transporting apparatus in which transporting rollers are rotated only when a bank note exists for preventing unnecessary rotation of the transporting rollers to enhance the durability of the transporting rollers and to reduce noise which is otherwise generated due to the rotation of the rollers.

In order to accomplish the above-mentioned object, in one aspect of the present invention, there is provided a paper strip transporting apparatus comprising drive and driven pulleys which are separated from each other; a belt which is disposed between and around said pulleys; a plurality of transporting rollers disposed along the belt between the drive and driven pulleys; and a drive unit for driving the drive pulley, either one of the transporting rollers and the belt having a convex portion and the other having a concave portion corresponding thereto at the facing areas thereof, the transporting rollers being disposed with respect to the belt so that the convex portion is positioned within the concave portion in a non contact relationship with each other.

The portion of each transporting roller facing the belt may have a shape corresponding to the sectional shape of the belt. For example, when the belt has a convex section, the portion of each transporting roller facing the belt is formed into a concave shape. More specifically, when the belt is substantially circular in section, the portion of each transporting roller facing the belt is provided with a concave portion having a curvature of radius which is larger than that of the belt. Each transporting roller is disposed with respect to the belt in such a manner that a curved space is formed between the belt and the portions of the transporting rollers facing the belt.

Each of the transporting rollers and the belts are disposed as closely as possible provided that the facing portions thereof are not in contact with each other. The spacing between the facing portions is appropriately preset depending upon the thickness, width and quality of the bank note. For example, the spacing may be slightly larger than the thickness of the bank note and is preferably in the range between one and three thicknesses of the bank note.

Each transporting roller comprises a pair of two rollers which are disposed in such positions that they face each other and sandwich the belt.

Specifically, the present invention is preferably applied to a paper strip transporting apparatus in which drive and driven pulleys are separated from each other and a round belt which is circulated in a transporting direction to transport the paper strip is disposed between and around the drive and driven pulleys.

In the transporting apparatus, the tension side round belt between the drive and driven pulleys, that is, the belt for transporting the paper strip is disposed along the paper strip transporting path. A plurality of pairs of transporting roller which bring the paper strip accepted into the transporting path in contact with the tension side round belt to successively transport them are continuously provided in a transporting direction. The transporting rollers which form one pair are disposed on the opposite sides of the tension side of the belt.

Each of the transporting rollers is formed with a groove so that the outer periphery of the round belt is positioned in close to the rollers but in no contact with the rollers. Each of the rollers is disposed in the vicinity of the belt in such a manner that part of the outer periphery of the round belt is positioned within the groove without contact therewith.

A biasing pulley may be provided in the vicinity of the drive pulley for sandwiching the round belt between the biasing pulley and the drive pulley. The biasing pulley is biased for biasing the round belt upon the drive pulley.

A plurality of supporting rollers for suppressing flexing of the round belt may be disposed below and along the loose side of the belt which is disposed between the drive and driven pulleys.

In a case where a plurality of transporting rollers are provided in the present invention, one of the transporting rollers of each pair may be fixedly provided and the other may be mounted on a detachable frame so that the paper strip transporting path is releasable.

The supporting roller may be mounted on the detachable frame under the loose side of the round belt.

When a paper strip is placed upon a transporting path in the thus formed transporting apparatus, the paper strip is placed into a space between a transporting belt which circulates in a transporting direction and a pair of transporting rollers which are disposed on the opposite sides of the belt. The paper strip which is placed in the space between the groove and the belt is flexed to conform with the configuration of the space between the inner wall of the groove and the outer periphery of the belt so that it is bent toward the groove of the transporting roller. The flexed paper strip is brought into contact with both the transporting roller and the belt by its resiliency. This causes the transporting roller to be driven by the rotating belt via the paper strip. That is, the transporting rollers are driven in association with the movement of the belt. This causes the paper strip to be transported along the transporting path.

In this case, the transporting belt does not directly contact with the transporting roller. Since the transporting roller is rotated only when it transports the paper strip, wear of the belt and the transporting rollers is reduced. Noise is also reduced.

In an embodiment of the present invention in which a biasing pulley is provided in the vicinity of the drive pulley, the belt is sandwiched between the drive pulley and the biasing pulley so that the belt is constantly pressed upon the drive pulley by the biasing pulley. Therefore, the belt is positively circulated in a transporting direction without slip or idling of the drive pulley.

The tension side of the belt which is disposed between the periphery of the drive and driven pulleys are disposed along the grooves of the plurality of transporting rollers which are continuously provided along the transporting path. The belt is not in direct contact with the transporting rollers. Therefore, inability of transportation due to removal of the belt from the transporting rollers is prevented.

In a case where supporting rollers are provided, the loose side of the belt between the other periphery of the drive and driven pulleys is prevented from flexing by a plurality of supporting rollers which are continuously provided along and below the belt. Contact or engagement of the belt with the other members is prevented.

In accordance with the present invention, the belt is not in direct contact with the transporting rollers. The loose side of the belt is prevented from flexing by the supporting rollers. Accordingly, it is not necessary to drive the belt to be circulated while keeping the belt at a constant tension with a strong force which is directed to overcome the frictional force with the transporting rollers. Therefore, a lower tension which is imposed upon the belt is required in comparison with the case in which the belt is in pressure contact with the transporting rollers. This eliminate the necessity of a tension mechanism which absorbs the elongation of the belt to keep the belt at a constant tension with a strong force. Reduction in cost and size can be achieved by simplifying the structure of the apparatus. Starting current required for starting a drive unit for driving the drive pulley can be reduced. The life time of the drive unit can be extended.

DETAILED DESCRIPTION OF THE PREFERRED EMBODIMENTS

A preferred embodiment of the present invention will now be described with reference to the drawings.

Figure 2:
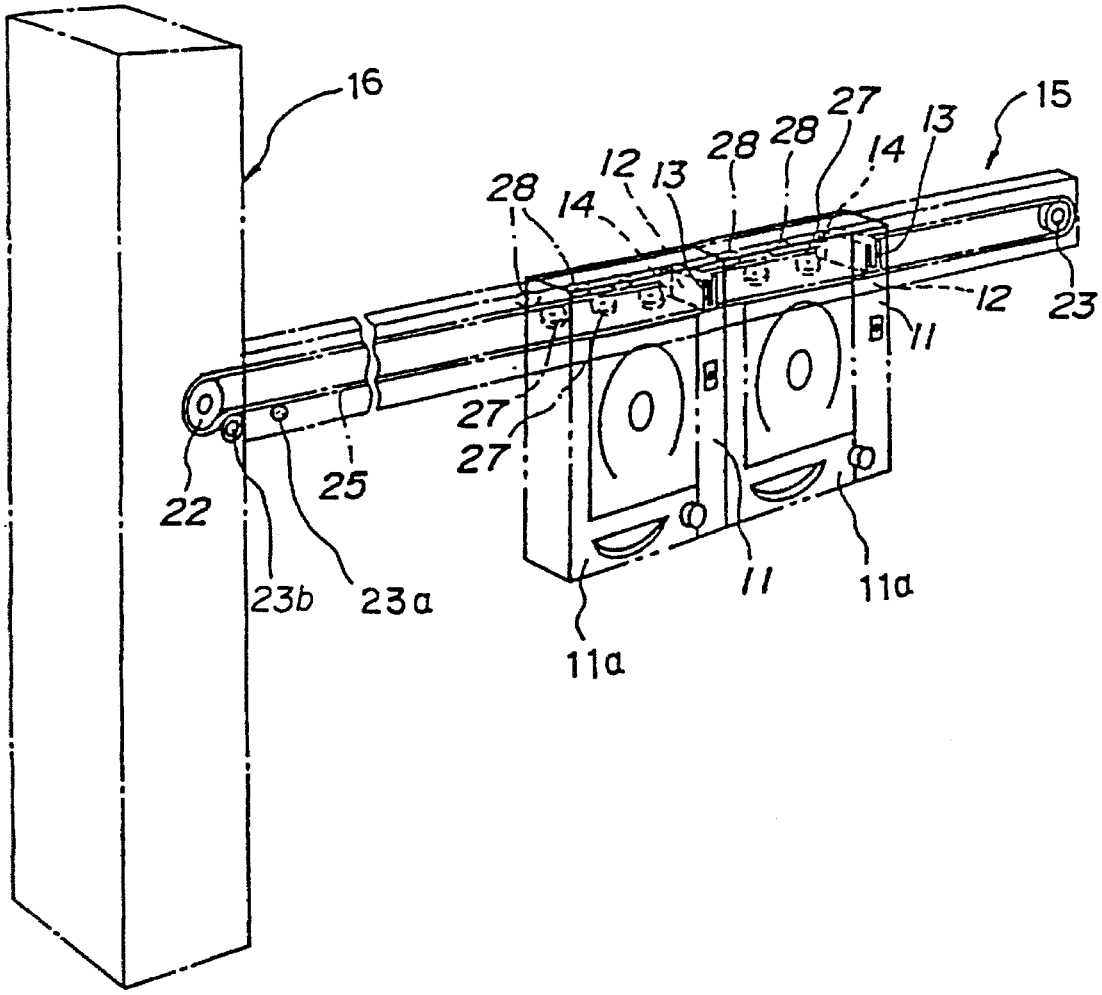
FIG. 2 is a perspective view showing a paper strip transporting apparatus of the embodiment of the present invention.

As best seen in FIG. 2, a paper strip transporting apparatus 10 of the present embodiment is disposed in a game machine island in which game machines 11*a*, 11*a* . . . and bill or bank note identifying machines 11 therebetween are disposed in a row and is used for transporting bank notes which are paper strips. The paper strip transporting apparatus 10 includes a charge collecting line (transporting path) 15 for collecting charges which is provided along the bank note identifying machines 11 and the game machine 11a disposed alternatively. A charge collecting unit 16 is provided at one end of the charge collecting line 15. The charge collecting line 15 constitutes a transporting path for collecting paper strips as charges from the bank note identifying machines 11 which are bank note processors and for transporting them to the charge collecting unit 16.

The bank note identifying machine 11 includes a bank note examining unit 12 having a bank note inserting slot 13 on the upper portion thereof, and a discharge slot 14 which opens rearward at the rear of the bank note examining unit 12.

Drive and driven pulleys 22 and 23 are disposed at the opposite ends of the charge collecting line 15 separately from each other. An endless round sectioned belt 25 is tensioned between the drive and driven pulleys 22 and 23. A plurality of pairs of transporting rollers 27 and 28 which face each other are provided along the tension side of the round sectioned belt 25 so that they sandwich the belt 25 therebetween.

Figure 4:
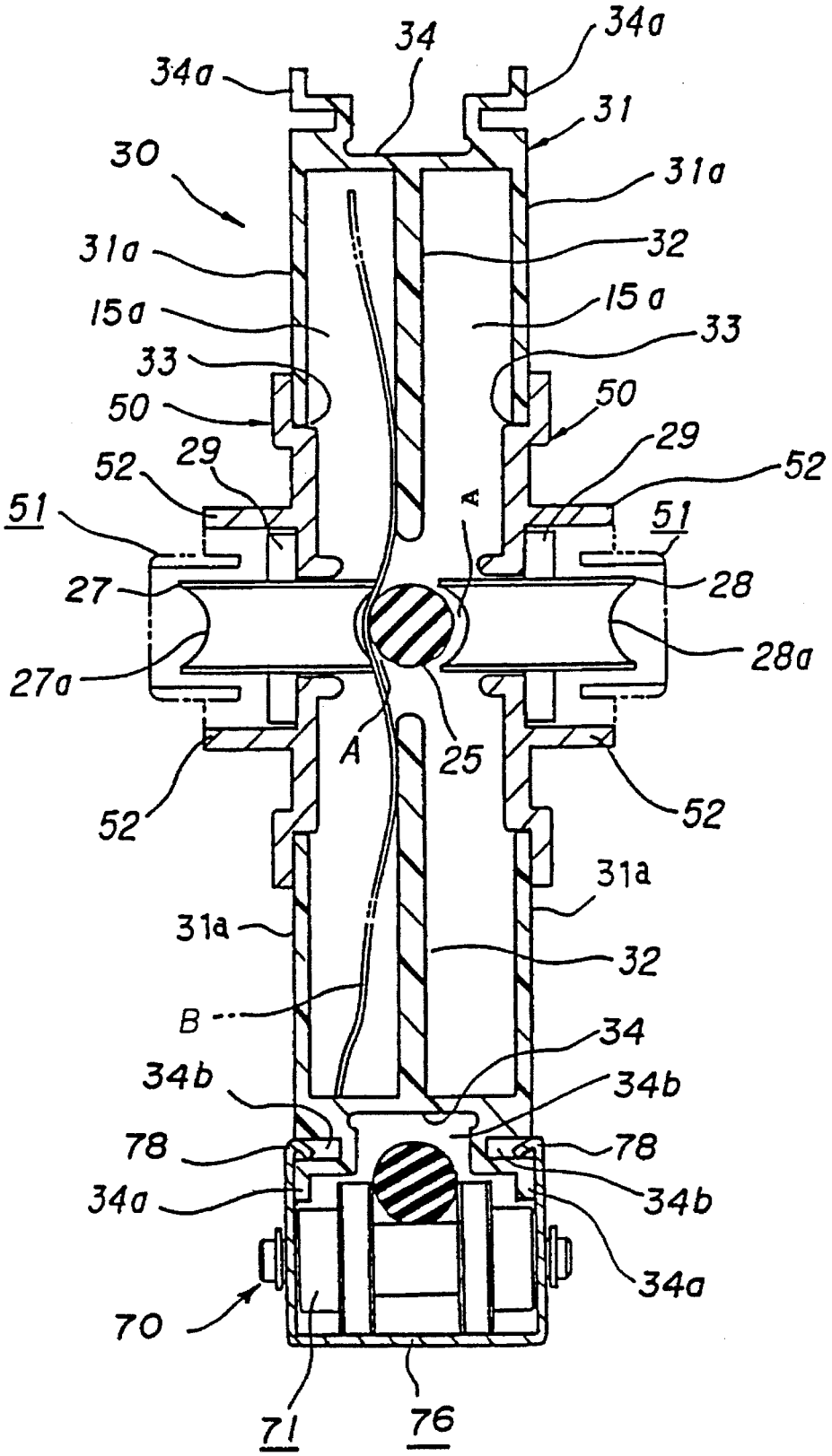
FIG. 4 is a sectional view taken along the line IV—IV in FIG. 1.

As shown in FIG. 4, each transporting roller 27, 28 is formed with grooves 27*a*, 28*a* on the outer periphery thereof into which the round belt 25 can be positioned in close relationship thereto while the outer periphery of the round belt 25 is not in contact therewith. A space A is formed between the groove 27*a*, 28*a* of the transporting roller 27, 28 and the round belt 25. The space A allows a paper strip B inserted therebetween to be flexed when the paper strip B is forcedly transported thereto. This causes the paper strips B to be brought into contact with the transporting rollers 27, 28 and the round belt 25 and to be consecutively transported. The size of the space A is appropriately preset depending upon the thickness of the bank note, paper quality, etc. and varies for example, between the thickness of the bank note and about two or three times the thickness of the bank note.

Figure 5:
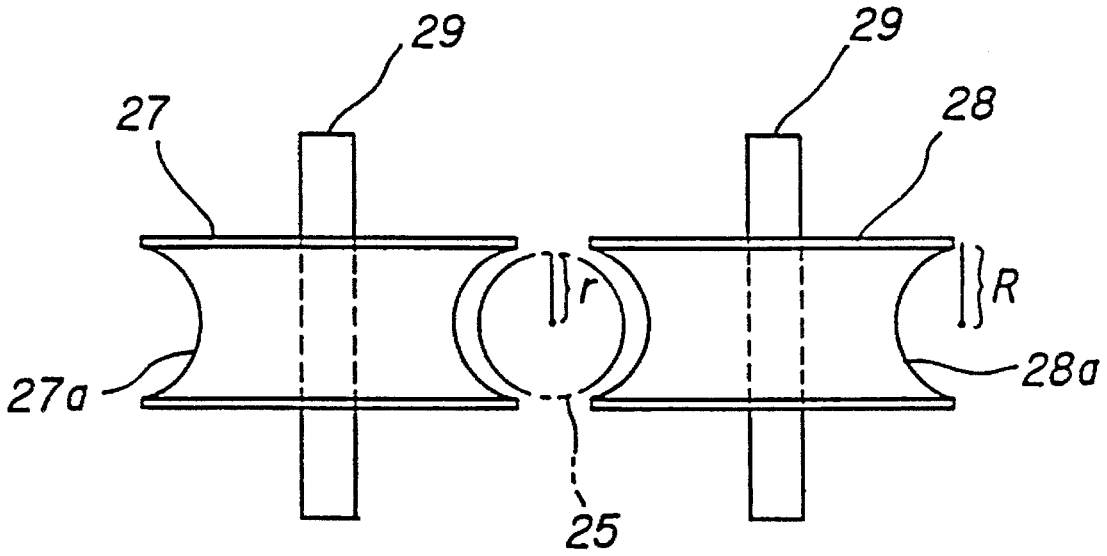
FIG. 5 is a front view showing a round belt and a pair of transporting rollers in the paper strip transporting apparatus of the embodiment of the present invention.

The grooves 27*a*, 28*a* of the transporting rollers 27, 28 are formed so that they have semicircular section as shown in FIG. 5. The radius R of the semi-circular curves of the grooves 27*a*, 28*a* is formed larger than the radius r of the circular section of the round belt 25. Thus, part of the outer periphery of the round belt 25 can enter into the grooves 27*a*, 28*a* of the transporting rollers 27, 28 without direct contact thereto so that a space A is kept therebetween.

As shown in FIG. 2, the discharge slot 14 from the bank note identifying machine 11 is communicated with the charge collecting line 15. The charge collecting line 15 comprises a transporting unit 30 for transporting bank notes to the charge collecting unit 16, an introducing unit 40 which is connected with the transporting unit 30 and a length adjusting unit 60 which is provided if necessary. The units 30, 40 and 60 are continuously provided. The introducing unit 40 is connected to the transporting unit 30 so that the connection position can be adjusted by changing the arrangement length of the transporting unit 30 by means of the length adjusting unit 60.

Figure 1:
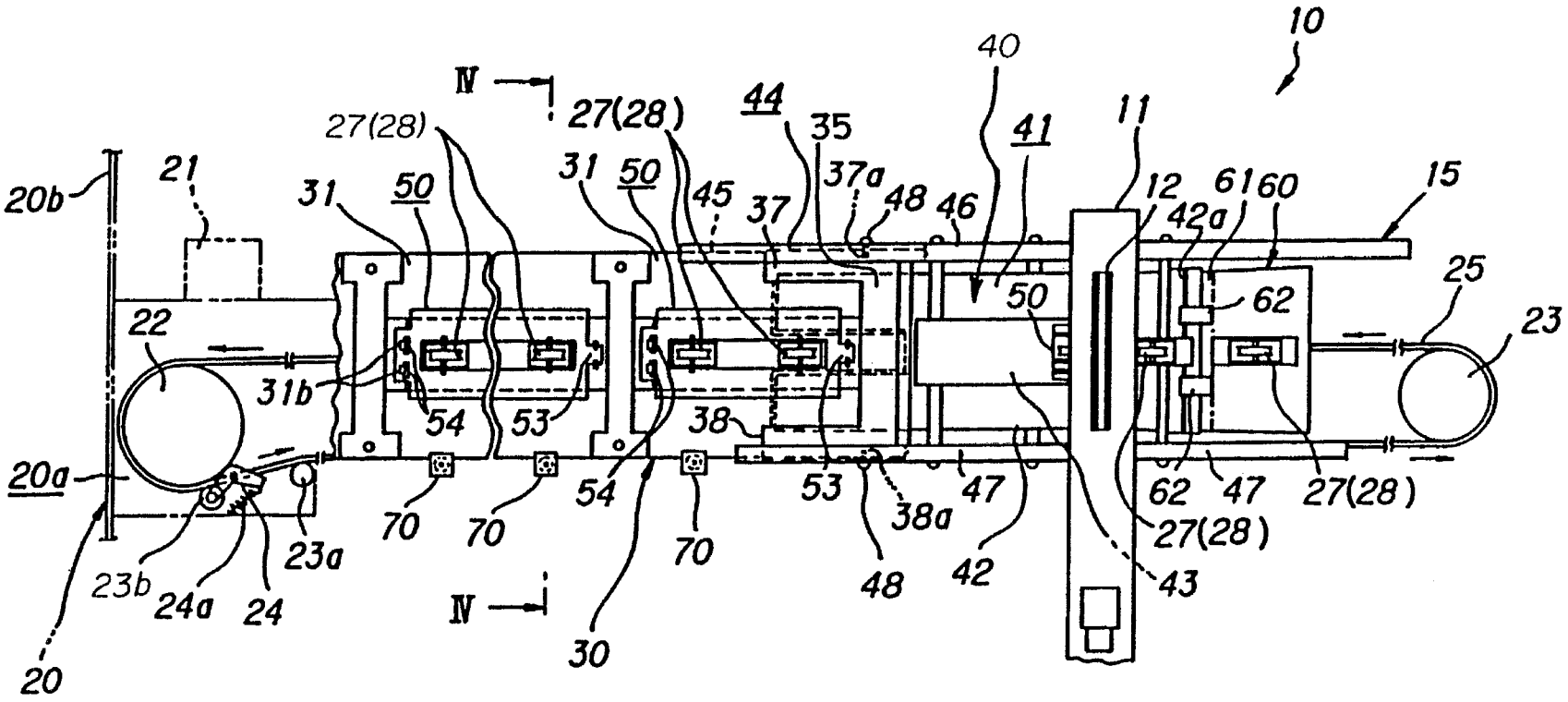
FIG. 1 is a front view showing a paper strip transporting apparatus of one embodiment of the present invention.
Figure 3:
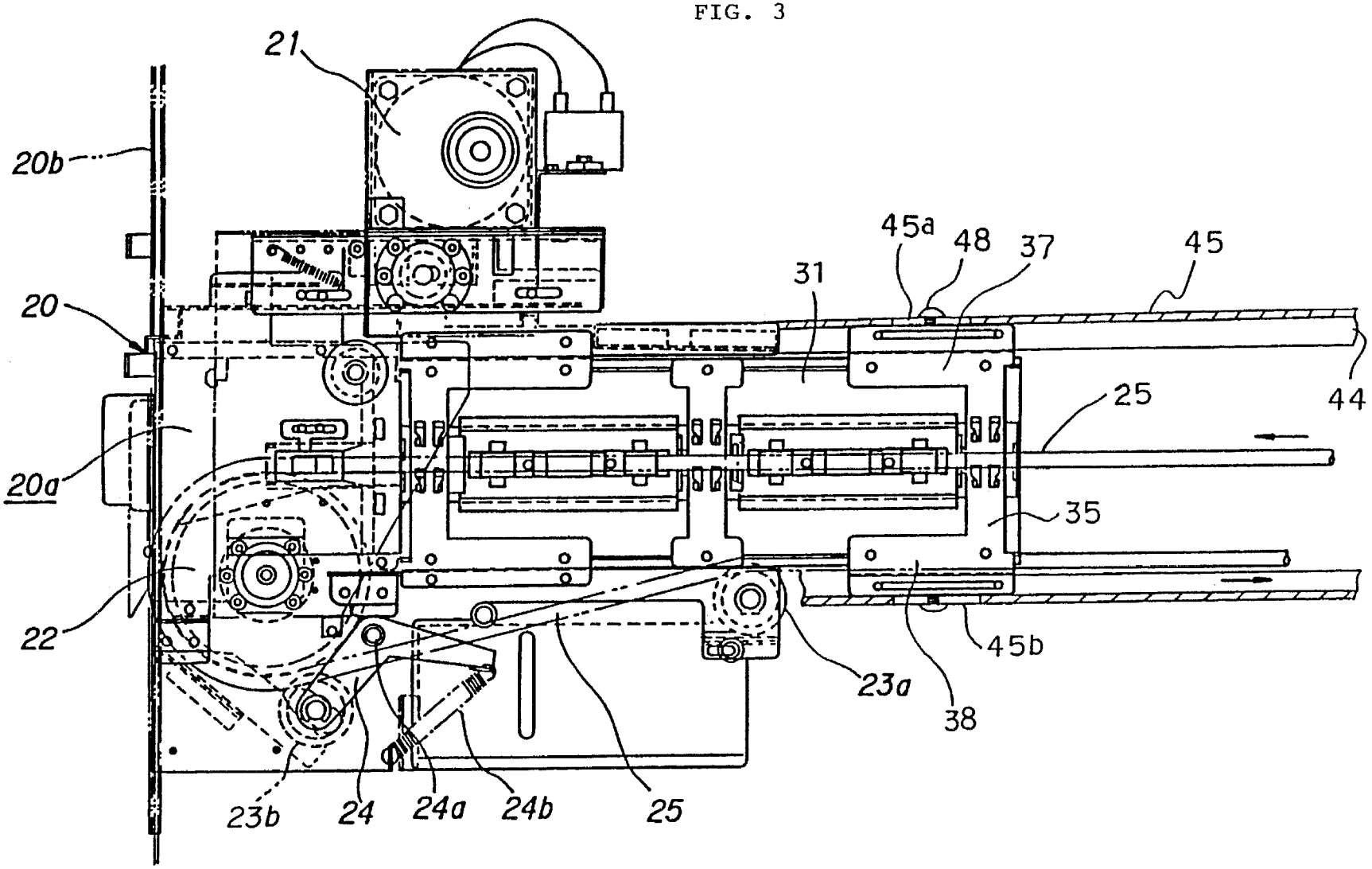
FIG. 3 is a front view showing a drive unit of the paper strip transporting apparatus of the embodiment of the present invention.

As shown in FIGS. 1 and 3, a drive unit 20 for circulating the round belt 25 is connected with one end of the charge collecting line 15. The drive unit 20 comprises a mounting frame 20*a* mounted on a side plate 20*b*, an electric motor 21 disposed on the mounting frame 20*a* and a drive pulley 22 which is driven to rot-ate by means of the electric motor 21.

A biasing pulley 23*b* is disposed below the drive pulley 22 in such a manner that it is rotatable. The biasing pulley 23*b* serves to sandwich the round belt 25 between it and the drive pulley 22 and to force the round belt 25 toward the drive pulley 22.

The biasing pulley 23*b* is rotatably mounted on one end of a substantially L-shaped arm member 24 as shown in FIG. 3. The biasing pulley 23*b* is pivotally supported via the arm member 24. The arm member 24 is pivotally supported on the mounting frame 20*a* via a shaft 24*a* in the substantially intermediate position of the arm member 24. The biasing pulley 23*b* on one end of the arm member 24 is pivotally supported and is biased by a coil spring 24*b* connected at the other end of the arm member 24 so that it is brought into pressure contact with the drive pulley 22.

A guide pulley 23*a* for guiding the beginning end of the loose side of the round belt 25 along the lower end of the transporting unit 30 is rotatably supported on the mounting frame 20*a*. The biasing pulley 23*b* and the guide pulley 23*a* are formed with grooves, which contact with part of the outer periphery of the round belt 25 is adapted.

As shown in FIG. 1, joint members 35 are secured to the front and rear sides of a transporting path member 31 made of a synthetic resin. The joint members 35 are provided with upper and lower connecting portions 37 and 38 at upper and lower ends thereof, respectively. The upper and lower connecting portions 37 and 38 are formed with screw holes 37*a* and 38*a*, respectively. The joint members 35 are connected with guide rail portions 45 of the connecting guide member 44 by screwing screw 48 into the screw holes 37*a* and 38*a* through the guide rail portion 45.

The guide rails 45 are provided in portions for connecting the joint members 35 with elongated holes 40*a* along the length thereof in a transporting direction. The mounting position of the guide rails 45 on the connecting guide members 44 is adjustable by changing the screwing position of the screws 48 into the screw holes 37*a* and 38*a* through the elongated holes 40*a*.

As is apparent from FIG. 4, the transporting path member 31 is formed with transporting grooves 33 on both of the side walls 31*a* so that a partition wall 32 is located between the side walls 31*a*. The transporting path member 31 is formed with groove frames 34 on the upper and lower portions thereof. Each groove frame 34 is formed on the opposite edges thereof with securing strips 34*a* which will be adapted to the joint member 35. The securing strips 34*a* extend in a longitudinal direction thereof.

Bank note transporting spaces 15*a* having a small width surrounded by the upper and lower partition walls 32, both of the side walls 31*a* and the upper and lower groove frames 34 are defined along the charge collecting line 15.

As shown in FIGS. 4, 8, 9 and 10, the transporting unit 30 is provided with the pair of transporting rollers 27 and 28. The number of pairs may be appropriately increased or decreased. Two transporting roller units 50 are disposed in an opposing manner on one roller 28 side of the rollers 27 and 28. The transporting roller units 50 include the pair of transporting rollers 27, 28 and a roller mounting frame 51. The roller frame 51 are provided with bearings 52 on which shafts 29 for rotatably bearing the rollers 27, 28 are mounted.

Figure 8:
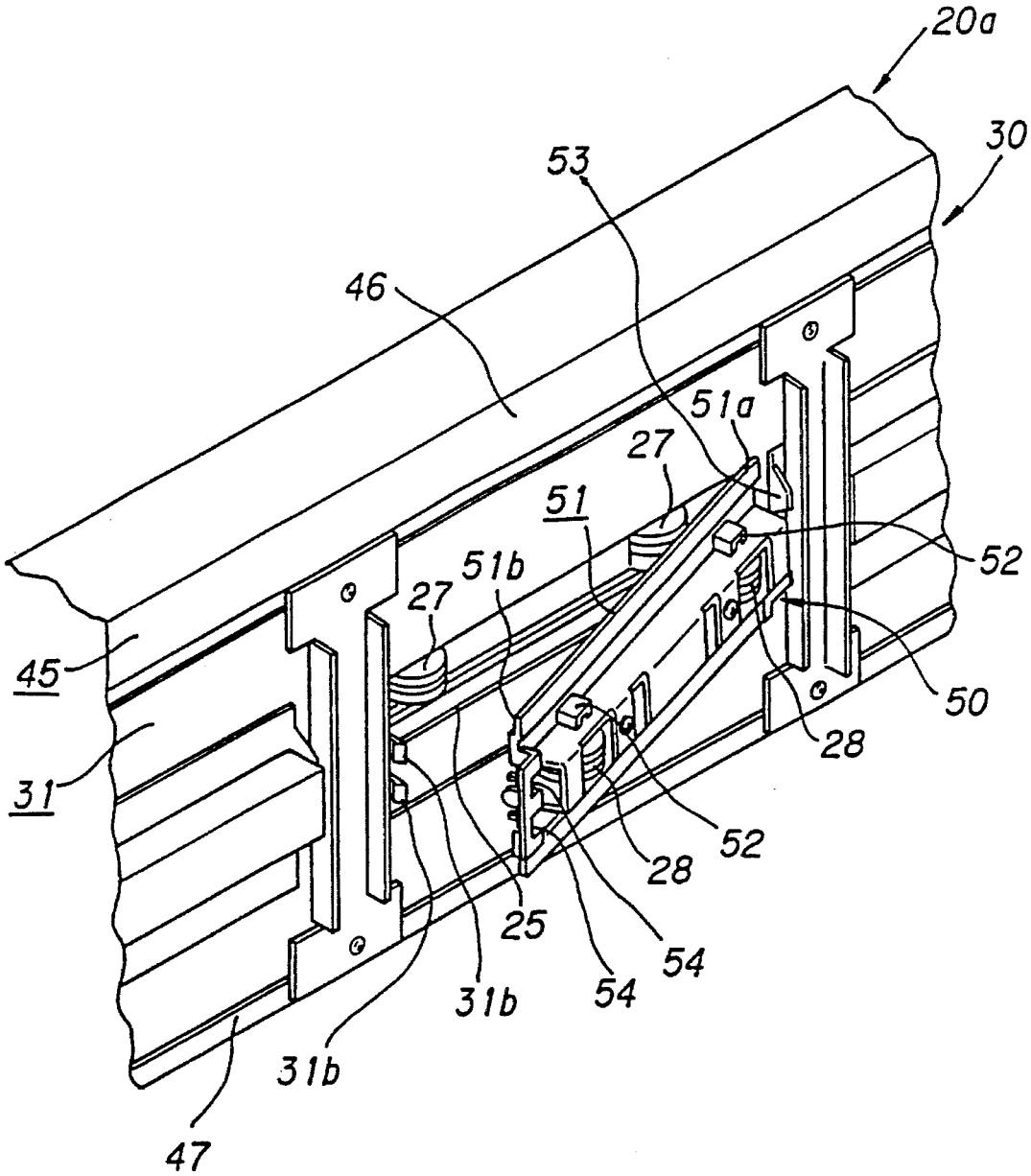
FIG. 8 is a perspective view showing a transporting unit used in the paper strip transporting apparatus of the embodiment of the present invention.
Figure 9:
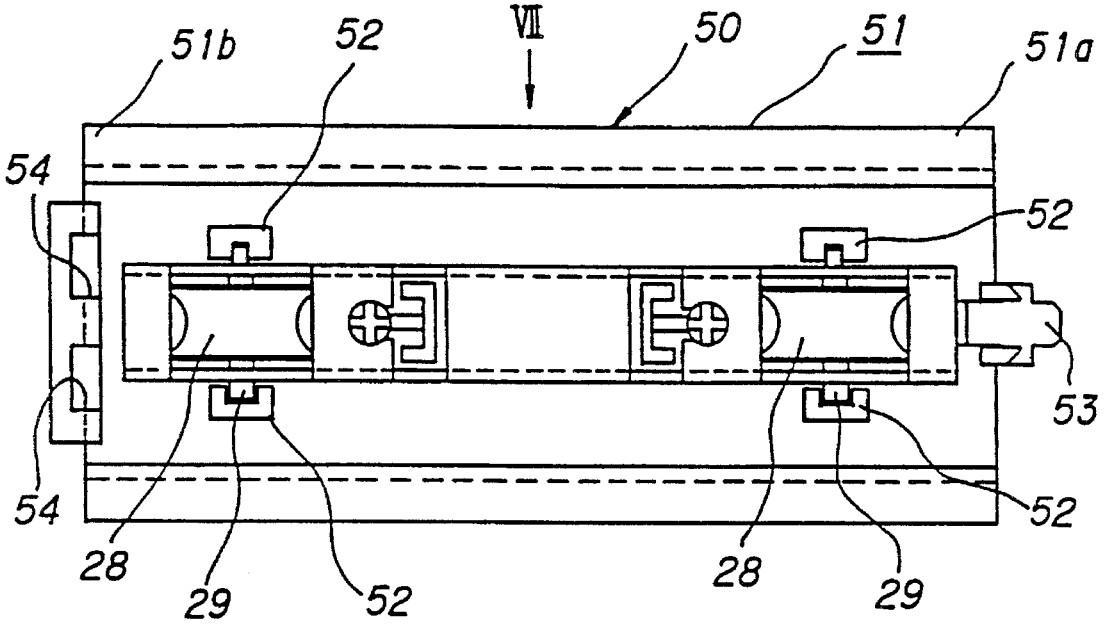
FIG. 9 is a front view showing an example of the structure of the transporting roller unit used in the present embodiment.
Figure 10:
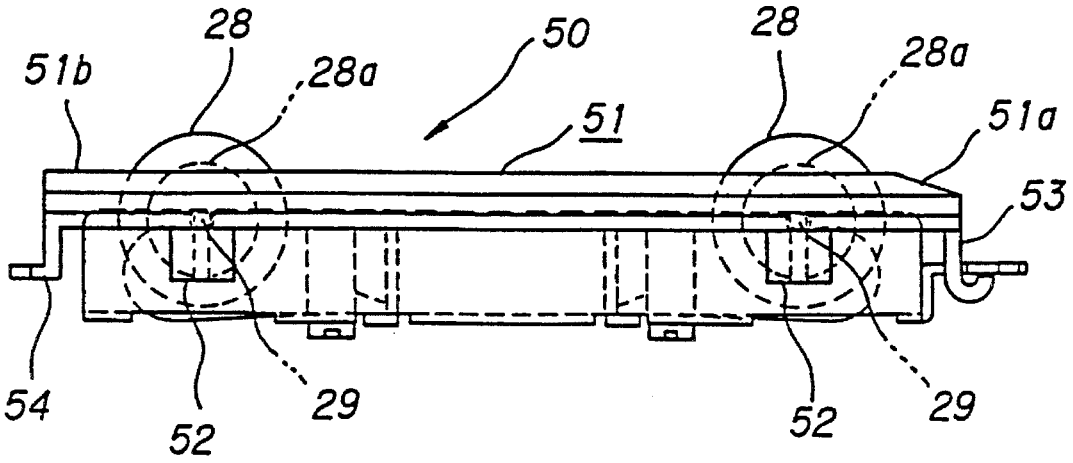
FIG. 10 is a view showing the transporting roller unit shown in FIG. 9 as viewed in an arrow VII in FIG. 9.

The transporting roller units 50 are detachably mounted on the side walls 31*a* of the transporting path member 31. As shown in FIGS. 8, 9 and 10, the transporting roller unit 50 includes a hinge portion 53 which is provided at one end 51*a* of the roller mounting frame 51 and engaging holes 54 at the other end 51*b*. The hinge portion 51 is secured to the transporting path member 31. The engaging holes 43 which are bored at the other end are disengagably engaged with hooks 31*b* which project from the transporting path member 31. This causes the transporting roller unit 50 to be pivotally mounted on the transporting path member 31.

Figure 6:
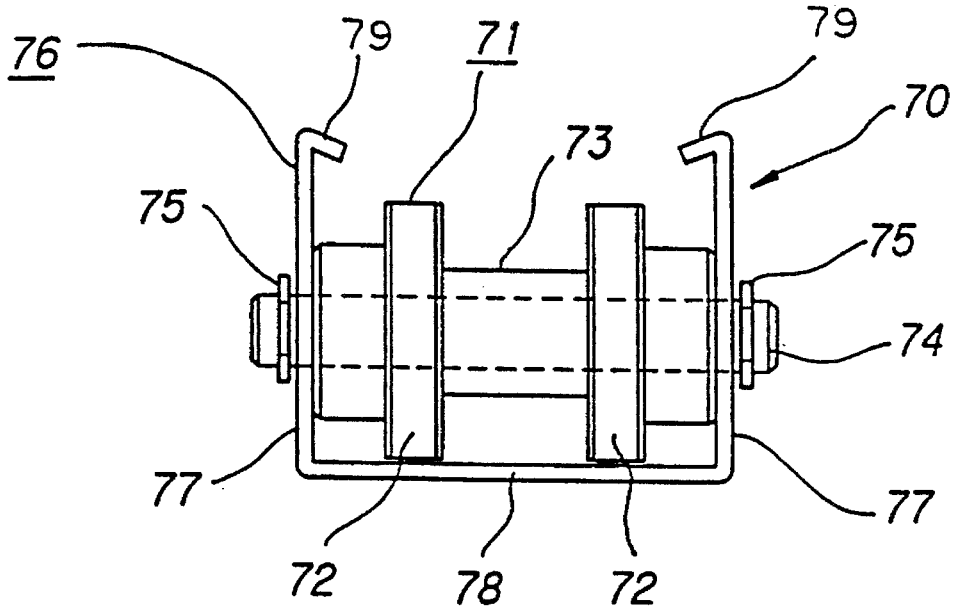
FIG. 6 is a front view showing a supporting roller unit in the paper strip transporting apparatus of the embodiment of the present invention.
Figure 7:
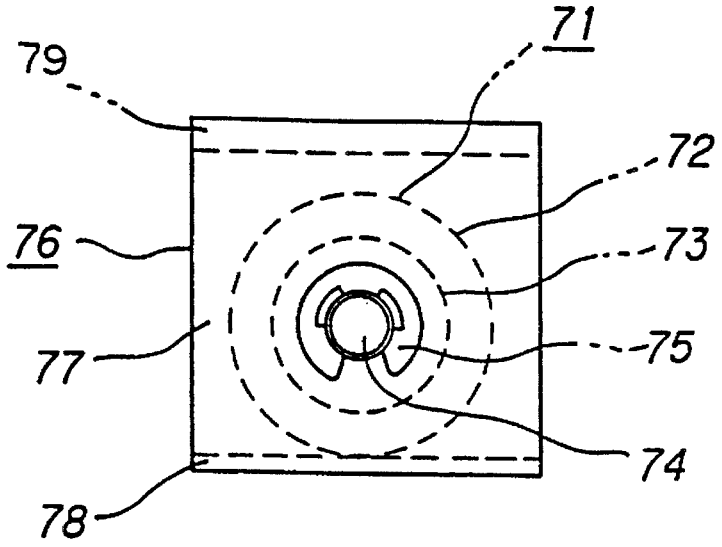
FIG. 7 is a side view showing the supporting roller unit in the paper strip transporting apparatus of the embodiment of the present invention.

As shown in FIG. 1, a plurality of roller units 70 for preventing the loose side of the round belt 25 from flexing are continuously provided on the lower side of the transporting path member 31. As shown in FIGS. 4, 6 and 7, the supporting roller unit 70 comprises a supporting roller 71 which is in direct contact with the round belt 25 to prevent the belt 25 from flexing and a frame 76 for rotatably supporting the supporting roller 71.

As shown in FIGS. 6 and 7, the supporting roller 71 comprises a roller shaft 74, a pair of ring members 72 into which the roller shaft 74 is fitted and a belt receiving groove 73 between the ring members 72. A space through which the loose side of the round belt 25 passes is defined by a groove frame 34 (refer to FIG. 4) on the lower side of the transporting path member 31 and the belt receiving groove 73.

The frame 76 comprises a bottom 78 and both side walls 77 so that it is in a substantially channel form. The roller shaft 74 of the supporting roller 71 extends through the opposite side walls 77 and E rings 75 are firmly secured to the opposite ends of the roller shaft 74.

Both side walls 77 are bent inwardly at the upper edges thereof to form engaging pawls 79. The engaging pawls 79 are formed in such a manner that they are removably engaged with fitting recesses 34b formed in the base end of the securing strip 34*a* of the transporting path member 31.

As shown in FIG. 1, the introducing unit 40 comprises a transporting path 42 which extends in a transporting direction of the round belt 25 on the introducing path member 41 made of a synthetic resin and an introducing path 43 for merging the discharge slot 14 (shown in FIG. 2) of the bank note identifying machine 11 with the transporting path 42. The introducing path member 41 is held by a connecting guide member 44.

As shown in FIG. 1, the connecting guide member 44 includes upper and lower guides 46 and 47, each of which includes a guide rail 45. The guide rail 45 of the upper guide 46 is fitted to the upper connecting portion 37 of the joint member 35 of the transporting unit 30. The guide rail 45 of the lower guide 47 is connected to the lower side of the lower connecting portion 38 of the joint member 35. The guide rail 45 is formed with an hole 40*a* which is elongated in a longitudinal direction and through which a connecting screw 48 is inserted.

The guide rail 45 of the introducing unit 40 is fitted to the joint member 35 of the transporting unit 30 and the end of the transporting path 42 of the introducing path member 41 of the introducing unit 40 is connected to the transporting path member 31 of the transporting unit 30 so that the transporting unit 30 is connected to the introducing unit 40. The length of connection between the transporting unit 30 and the introducing unit 40 is adjusted within the range of the length of the elongated hole 40*a* when the connecting screw 48 is unscrewed.

As shown in FIG. 1, the length adjusting unit 60 is formed at the end thereof with a connecting portion 61 which is fitted to one end of the transporting path 42 of the introducing path member 41 of the introducing unit 40. The connecting portion 61 is provided with hook portions 62 which are disengageable from or engageable with engaging steps 42*a* formed at one end of the transporting path 42. A pair of transporting rollers 27 and 28 are disposed midway of the length adjusting unit 60.

The tension side of the round belt 25 is provided to pass through a space between the pairs of the transporting rollers 27 and 28 which are provided in the charge collecting line 15, constructed by the introducing unit 40 and the transporting unit 30 or the length adjusting unit 60.

Now, operation of the present embodiment will be described.

As shown in FIGS. 1 and 2, the drive pulley 22 of the drive unit 20 is driven to rotate by the electric motor 21. At this time, the round belt 25 is sandwiched between the drive pulley 22 and the biasing pulley 23*b* laying under the drive pulley 22 within the drive unit 20. The round belt 25 is constantly biased toward the drive pulley 22 by the biasing pulley 23*b*. Accordingly, rotational torque of the drive pulley 22 is positively transmitted to the round belt 25.

In accordance with the above mentioned operation, the tension side of the round belt 25 on the upper side between the drive and driven pulleys 22 and 23 as shown in FIG. 1 without slipping of the round belt 25 nor idling of the drive pulley 22. This also reduces starting drive current required for starting the transportation and eliminates noise of transporting rollers 27 and 28 on transportation and extends the lifetime of the drive means such as an electric motor 21.

Since the tension side of the round belt 25 passes through spaces between the grooves 27*a*, 28*a* of the plurality of pairs of transporting rollers 27, 28 which are provided on the opposite sides thereof therealong and are not in contact with the transporting rollers 27 and 28, the round belt 25 will not be removed from the transporting rollers 27, 28 so that inability of transportation is prevented. This enhances transportation efficiency.

As shown in FIG. 4, the round belt 25 in the tension side passes through between the grooves 27*a* and 28*a* of a plurality of pairs of transporting rollers 27 and 28 provided along the tension side of the round belt 25. Because the round belt 25 does not contact with each of the transporting rollers 27 and 28, it will not get off from each of the transporting roller 27, 28. This prevents the disability of transporting from occurring and the transporting efficiency is enhanced.

On the other hand, the loose side of the round belt 25 between the lower peripheries of the drive and driven pulleys 22 and 23 is surrounded by the transporting path member 31 and a plurality of supporting roller units 70 mounted on the lower end of the transporting path member 31 in a longitudinal direction thereof. The flexing of the round belt 25 is suppressed by the supporting rollers of the supporting roller units 70. This prevents the loose side of the round belt 25 from largely flexing to engage with the other member.

In such a manner, the round belt 25 passing through between the transporting rollers 27 and 28 does not directly contact with the transporting rollers 27 and 28 and the loose side round of the belt 25 is prevented from flexing by the supporting rollers 71. Accordingly, it is not necessary to drive the round belt 25 while keeping it at a constant tension by a strong force against the frictional force between the round belt 25 and the transporting rollers 27 and 28.

This eliminates the necessity of a tensioning mechanism for absorbing the elongation of the round belt 25 and for keeping the round belt 25 at a constant tension by a large force. Simplification of the structure of the apparatus and reduction in cost and size can be achieved. Starting current which is required for the electric motor 21 to start transportation is reduced, resulting in an extension of the life time of the electric motor 21 and elimination of noise of the transporting rollers 27 and 28 during transportation.

When a paper strip B is discharged from the discharge slots 14 of the bank note identifying machine 11 to the introducing path 43 in FIGS. 1 and 2, the paper strip B is transported through the introducing path 43. After the front end of the paper strip B reaches the pair of the transporting rollers 27 and 28 in the vicinity of the terminal of the introducing path 43, the paper strip B is transported by the transporting rollers 27 and 28 therefrom and is merged with the transporting path 42.

The paper strip B which has been forced into the bank note transporting space 15a which is on the left side in FIG. 4 is disposed in the space A between the round belt 25 on the tension side which is circulated in a transporting direction and one of the transporting rollers 27 which are on the opposite sides of the round belt 25.

Since the transporting roller 27 is disposed in such a manner that part of the outer periphery of the round belt 25 is positioned within the groove 27*a* of the transporting roller 27, the space A has a curved configuration. The paper strip B which is disposed in the space A having such a curved configuration between the groove 27*a* and the round belt 25 is flexed along the contours of the groove 27*a* and the outer periphery of the round belt 25 to be urged into the groove 27*a* of the transporting roller 27. The flexed paper strip B is bent into an L-shape which gives it rigidity.

Since part of the outer periphery of the round belt 25 is positioned in the groove 27*a* of the transporting roller 27 without contact with the roller 27, the paper strip B which is flexed in the space A has such a large contact friction for the round belt 25 that it is positively transported through the bank note transporting space 15*a* by the frictional force.

At this time, the flexed paper strip B is brought into contact with both of the transporting roller 27 and the round belt 25 by its resiliency. This causes the paper strip B to be transported by the moving round belt 25 and the transporting rollers 27 with are driven to rotate by the round belt 25 via the paper strip B which the paper strip in an erected position.

The pair of the transporting rollers 27 and 28 are rotated only on transportation of the paper strip B as shown in FIG. 4. Therefore, wear of the round belt 25 and the transporting rollers 27 and 28, the shafts 29, etc. is reduced, resulting in an increase in durability.

Furthermore, removal of the round belt 25 from the transporting rollers 27 and 28 is eliminated. This enhances transportation efficiency.

If difficulty in transportation in the bank note transporting spaces 15*a* should occur, the transporting roller unit 50 is opened as shown in FIG. 8. That is, in order to unlock the other end 51*b* of the roller mounting frame 51, the hook 31*b* of the transporting path member 31 is disengaged from the engaging holes 54 of the other end 51*b*. The roller mounting frame 51 can be then opened by pivoting the frame 51 around the hinge 53 at one end 51*a* thereof.

Since either one of the transporting rollers 27, 28 is separated from the round belt 25 by opening the transporting roller unit 50, the insides of the bank note transporting space 15*a* and the transporting unit 30 can be easily accessed for inspection or repair.

Since the supporting roller unit 70 can be easily removed from the lower end of the transporting path member 31 by opening the engaging pawls 79 of the frame 76 outwardly against their spring force, the faulty supporting roller 71 can be easily replaced with a new one.

Although the paper strip transporting apparatus in the above mentioned embodiment is applied for the charge collecting lines in the game machine islands or rows, it is to be understood that the present invention is not limited to this embodiment. For example, the present invention can be embodied for the charge collecting lines for group management such as ticket vending machines. It is also understood that the paper strip B is not limited to only bank note, but it may be slips or the like.

The supporting roller unit of the embodiment is arranged in such a manner that one supporting roller is supported below the loose side of the round belt by a detachable frame. However, the supporting roller unit may be so arranged that a plurality of supporting rollers are supported on the frame.

Although the round belt 25 is preferably used in the above mentioned embodiment, it is to be understood that the present invention is not limited to only the round belt 25. For example, belts having various sectional shapes such as oval or square may be used.

Furthermore, the groove of the transporting rollers is not limited to only semi-spherical in section, but may be channel shaped or V-shaped in section.

As mentioned above, in the paper strip transporting apparatus of the embodiment of the present invention, pairs of transporting rollers which are disposed on the opposite sides of the tensioned side of the round belt are not in direct contact with the round belt. Part of the outer periphery of the round belt is positioned in the grooves of the transporting rollers. Accordingly, the transporting rollers are rotated only when the paper strip is inserted between the transporting rollers and the round belt. Wear of the round belt and the transporting rollers is reduced to enhance their durability. Since the round belt is biased toward the drive pulley by the biasing pulley, removal of the round belt from the transporting rollers is prevented. The belt can be positively moved by a simple structure. Since flexing of the loose side of the round belt is suppressed by the supporting rollers, the paper strip can be conveniently transported while suppressing loosening and flexing of the round belt.

Enhancement in the durability due to reduction in wear of the round belt and transporting rollers results in reduction in cost. Necessity for an excessively large belt to overcome wear thereof is eliminated. This results a reduction in size of the whole of the apparatus.

Since the friction between the round belt and the transporting rollers occurs only when a bank note exists, a load imposed upon the belt is reduced. There is an advantage in that a low drive power is required for a unit for driving the drive pulleys. This achieves reduction in power consumption and size of the drive unit. Since the friction generally decreases on starting of transportation, starting current for the drive pulley is reduced and the life time of the electric motor which is a drive mover can be extended.

The transporting rollers which do not contribute to transportation are not brought into contact with the belt. Accordingly, noise of the transporting rollers can be reduced on transportation.

If the transporting roller unit is formed in such a manner that the supporting roller for suppressing the round belt on the loosing side is supported on a detachable frame in the vicinity of the round belt, the detachable .frame can be easily removed. Faulty supporting roller can be easily replaced with new roller.

What is claimed is:

1. A paper strip transporting apparatus, comprising:

a drive pulley and a driven pulley, separated from each other;

a belt which is disposed between and around said drive and driven pulleys;

a plurality of transporting rollers, disposed along the belt between the drive and driven pulleys; and a drive unit for driving the drive pulley;

either one of the transporting rollers and the belt having a convex portion and the other having a concave portion at corresponding facing areas thereof, the transporting rollers being disposed with respect to the belt so that the convex portion is positioned within the concave portion in a non-contacting relationship and such that the convex portion is spaced apart from the concave portion by a distance selected to be in the range of a single thickness of a paper strip passing therebetween to three times the thickness of the paper strip.

2. A paper strip transporting apparatus according to claim 1, wherein:

portions of the transporting rollers facing the belt each have a cross-sectional shape corresponding to a cross-sectional shape of the belt.

3. A paper strip transporting apparatus according to claim 2, wherein:

a portion of the belt facing the transporting rollers has a convex cross-section and said portions of the transporting rollers have concave cross-sections.

4. A paper strip transporting apparatus according to claim 3, wherein:

the cross-section of the belt is substantially circular in shape.

5. A paper strip transporting apparatus according to claims 4, wherein:

the portions of the transporting rollers facing the belt are concave in shape and have a radius of curvature of the concave shape which is larger than a radius of curvature of cross-section of the belt.

6. A paper strip transporting apparatus according to claim 5, wherein:

each transporting roller comprises a pair of rollers which are disposed to face each other and sandwich the belt therebetween.

7. A paper strip transporting apparatus according to claim 6, wherein:

each transporting roller has on an outer periphery thereof a groove into in which a part of the outer periphery of said belt is positioned in contact and in a close relationship therewith, each roller being disposed in the vicinity of the belt in such a manner that part of an outer periphery of the belt is positioned within the groove with no contact therewith.

8. A paper strip transporting apparatus according to claim 7, further including:

a biasing pulley provided in the vicinity of the drive pulley for sandwiching said belt between the biasing pulley and the drive pulley, said biasing pulley being biased for biasing said belt upon said drive pulley.

9. A paper strip transporting apparatus according to claim 8, further including:

a plurality of supporting rollers for suppressing flexing of the belt, disposed below and along a loose side of the belt which is disposed between respective opposite peripheries of said drive and driven pulleys.

10. A paper strip transporting apparatus, comprising:

drive pulley and driven pulley, separated from each other;

a belt which is disposed between and around said drive and driven pulleys;

a plurality of transporting rollers;

a drive unit for driving the drive pulley; and a supporting unit for supporting the transporting rollers which are disposed along the belt;

each of the transporting rollers including a pair of rollers which are disposed to sandwich the belt and face each other, a predetermined number of said pairs of rollers being mounted on the supporting unit;

either one of the transporting rollers and the belt having a convex portion and the other having a concave portion at corresponding facing areas thereof, the transporting rollers being disposed with respect to the belt so that the convex portion is positioned within the concave portion in a non-contacting relationship and such that the convex portion is spaced apart from the concave portion by a distance selected to be in the range of a single thickness of the paper strip passing therebetween to three times the thickness of the paper strip.

11. A paper transporting apparatus according to claim 10, wherein:

said supporting unit includes a stationary unit which is fixedly provided along the belt and a movable unit which is detachably mounted on said stationary unit, one of a pair of transporting rollers being mounted on the stationary unit and the other being mounted on the movable unit.

* * * * *